United States Patent [19]

Gössler

[11] 4,267,815

[45] May 19, 1981

[54] THERMAL CUT-OUT FOR GAS-HEATED GLASS CERAMIC COOKING SURFACES

[75] Inventor: Gerhard Gössler, Oberderdingen, Fed. Rep. of Germany

[73] Assignee: E.G.O. Elektro-Gerate Blanc u. Fischer, Oberderdingen, Fed. Rep. of Germany

[21] Appl. No.: 70,451

[22] Filed: Aug. 28, 1979

[30] Foreign Application Priority Data

Sep. 7, 1978 [DE] Fed. Rep. of Germany ... 7826549[U]

[51] Int. Cl.[3] ..... F24C 3/04; H01H 37/48

[52] U.S. Cl. ..... 126/39 G; 126/39 H; 126/39 J; 337/394

[58] Field of Search ..... 337/382–394, 337/397, 398, 400; 126/39 BA, 39 D, 39 G, 39 H, 39 J; 73/363; 219/449; 431/42, 43, 78

[56] References Cited

U.S. PATENT DOCUMENTS

| | | | |
|---|---|---|---|
| 1,387,618 | 8/1921 | Robertshaw | 126/39 G |
| 1,776,240 | 9/1930 | Wuensch | 73/363 |
| 2,529,941 | 11/1950 | Hollister | 337/389 |
| 3,906,424 | 9/1975 | Clancy et al. | 337/394 |
| 4,080,153 | 3/1978 | Wolfe | 337/387 |
| 4,135,081 | 1/1979 | Fischer | 337/386 |
| 4,201,184 | 5/1980 | Scheidler et al. | 126/39 J |

*Primary Examiner*—William H. Beha, Jr.
*Attorney, Agent, or Firm*—Steele, Gould & Fried

[57] ABSTRACT

A thermal cut-out for gas-heated glass ceramic cooking surfaces has a temperature sensor extending from a switch housing which contains a snap switch. The sensor consists of a tube with a rod therein, the tube and at least one portion of the length of the rod having differing coefficients of thermal expansion. The temperature sensor is surrounded by an enveloping tube which is at a distance from the temperature sensor.

14 Claims, 4 Drawing Figures

THERMAL CUT-OUT FOR GAS-HEATED GLASS CERAMIC COOKING SURFACES

FIELD OF THE INVENTION

The invention relates to a thermal cut-out for gas-heated glass ceramic cooking surfaces.

BACKGROUND OF THE INVENTION

Cooking surfaces of this type have been disclosed in German Auslegeschrift No. 24 40 701 and German Offenlegungsschrift No. 26 41 274. They have a gas-heated radiant burner comprising a burner plate which is provided with a radiant surface which is arranged at a small distance from the glass ceramic plate and heats it. The gas burner is operated intermittently, i.e. is turned on and off at a predetermined rhythm depending on the desired power supply. It is necessary to light the gas each time and, in addition, the gas flame has to be monitored so that no unconsumed gas is able to escape. The supply of gas is controlled by means of a magnetic valve which is controlled by means of a pulsating power control instrument.

Glass ceramic surfaces are sensitive to over-heating, but must be brought to a temperature which is as near as possible to but just below the permitted maximum temperature in order to ensure that sufficient power is transmitted through them.

In order to limit this temperature and to keep it as accurate as possible, experiments have been carried out using thermal cut-outs of the type disclosed in German Offenlegungsschrift No. 24 22 625. A thermal cut-out of this type, arranged between the radiant surface and the glass ceramic cooking surface, has not produced satisfactory results since the switching frequency is too high and unstable intermediate positions occurred with a relatively high adjustment and increase required in the contact distance and this prevents satisfactory switching and, in particular, good cooperation with the electronic control means for ignition and monitoring of the ignition.

BRIEF SUMMARY OF THE INVENTION

The object of the invention is therefore to provide a thermal cut-out for gas-heated glass ceramic cooking surfaces which allows both a sufficiently low switching frequency and control of the temperature which is as accurate as possible to the critical glass ceramic temperature, and which switches in a reliable and clearly defined manner.

According to the invention there is provided a thermal cut-out for gas-heated glass ceramic cooking surfaces comprising a switch housing, a snap switch arranged in the said housing, a temperature sensor extending from the switch housing and cooperating with the snap switch, the temperature sensor comprising a tube with a rod arranged therein, the tube and at least one portion of the length of the rod having differing coefficients of thermal expansion, and an enveloping tube which surrounds the temperature sensor at a distance therefrom.

The rod can consist partially of a material having the same thermal expansion as the tube in order to prevent the snap switch system from being over-stretched too much in the cold condition.

The enveloping tube, which preferably consists of metal, and more preferably of stainless steel, can be kept at a distance from the temperature sensor, for example by beads or mouldings in the shape of studs, and can be pushed loosely over the temperature sensor. It need not be sealed at the ends in this arrangement. It protects the temperature sensor from the direct radiant heat, but does not insulate the sensor so much from the temperature to be detected as to make it impossible to control accurately the maximum temperature of the glass ceramic. In addition, the temperature sensor is protected from the immediate influence of the flames, which, under certain circumstances could lead to corrosion or a one-sided thermal loading of the sensor. Stainless steel with its low thermal conductivity is particularly suitable. Moreover, the enveloping tube distributes the heat uniformly over the entire sensor so that any inactive portions of the rod cannot have a detrimental effect under extreme loads.

In any case, it has been found that with the thermal cut-out according to the invention it is possible to limit the temperature to a relatively constant value without an initial temperature peak, after a heating up phase, without the switching frequency being unacceptably high.

The temperature sensor can advantageously be arranged between the glass ceramic cooking surface and a burner plate of the gas heater designed as a radiant surface, projecting substantially diametrally beyond it. The switch housing and the free end of the temperature sensor containing, on the one hand, the switch and, on the other hand, an adjusting means, can preferably project beyond the burner plate, and the enveloping tube can be arranged only in the region of the radiant surface. This allows assembly and maintenance of the thermal cut-out to be carried out in a particularly simple manner.

Figure 1:
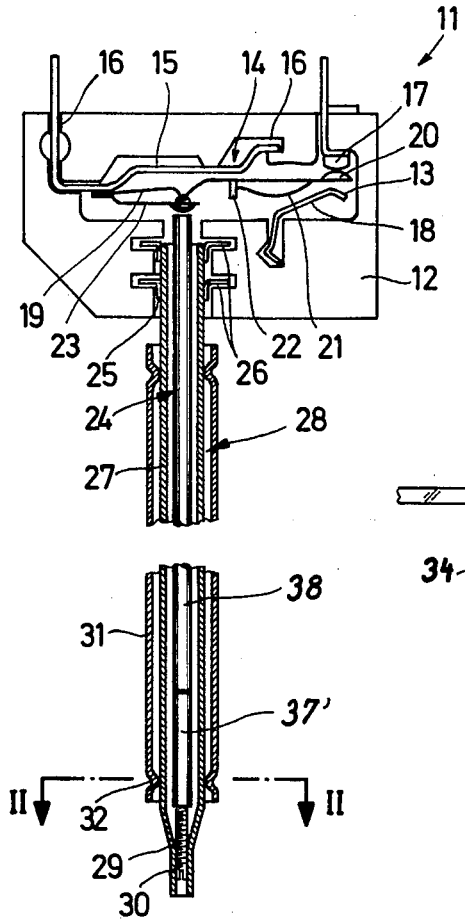
FIG. 1 shows an embodiment of the thermal cut-out in a plan view of the regulator housing and a section through the sensor.

The thermal cut-out 11 illustrated in FIG. 1 has a housing 12 consisting of insulating material, for example steatite, in the form of a rectangular plate which is chamferred on one edge. The housing defines a recess 13, in which a snap switch 14 is arranged, the recess being made in its lateral face lying at the top in the drawing. The snap switch has a holder 15 shaped from strips of sheet metal which at the same time forms one of the switch terminals and is inserted from the side lying at the top in FIG. 1 into corresponding slots 16 in the housing 12 which are adjacent to the recess 13 and thus secure the holder. A fixed contact 17, whose holder forms the second terminal, and an abutment 18 which determines the contact distance are similarly provided.

One side of a catch spring 19 is fixed on the holder 15 and the other side carries a moving contact 20. A spring contact tongue 21 which is stamped out of the catch spring rests on a support bearing 22 which is bent from the holder 15. A spring arm 23 is fixed to the catch spring 19, one end of the arm 23 holding a contact member which ensures that mechanical contact is made between a ceramic rod 24 and the actuation point of the catch spring 19.

A groove-like recess 25 runs from the recess 13 to one of the longitudinal narrow sides of the housing 12. A temperature sensor tube 27 is fixed in the recess 25 by two sheet metal flanges 26 which are pushed over it and bonded to it, and the temperature sensor tube 27, together with the ceramic rod 24 running inside the temperature sensor tube forms the temperature sensor 28 of the thermal cut-out 11. The temperature sensor tube 27 is reduced in diameter at its end 29 and bears at that end an internal screw thread into which is screwed an adjusting screw 30 which rests on the rod 24 and by means of which the limiting temperature can be adjusted. In a preferred embodiment, the rod 24 consists of two portions 37',38. The portion 37' is composed of a special steel which has the same coefficient of thermal expansion as the tube 27. In this way, one part of the sensor 28 is "inactive" so that the catch spring 19 is not bent so far upwards in the cold condition. The portion 38 of the rod 24, which is designed as a separate member, is made of ceramic material and has a different coefficient of thermal expansion from the tube 27.

Figure 2:
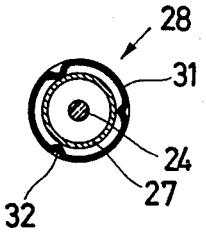
FIG. 2 shows a section on an enlarged scale along the line II—II in FIG. 1.

The temperature sensor 28 is surrounded by an enveloping tube 31 which is made of stainless steel and is a few millimeters larger in diameter than the temperature sensor. An air gap is thus formed between the enveloping tube 31 and the temperature sensor 28, which is kept constant since the enveloping tube has mouldings 32 at both ends in the form of beads or studs. FIG. 2 shows that three mouldings are provided on the circumference in each case. The air gap between the enveloping tube and the temperature sensor is also open on both sides and the enveloping tube can move freely on the temperature sensor in the longitudinal direction. If desired, the gap between the temperature sensor and the enveloping tube can be filled with insulating material.

Figure 4:
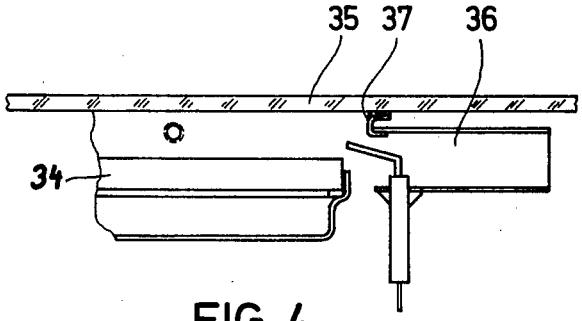
FIG. 4 shows a partially cut away side view of the unit illustrated in FIG. 3 as well as the glass ceramic plate.
Figure 3:
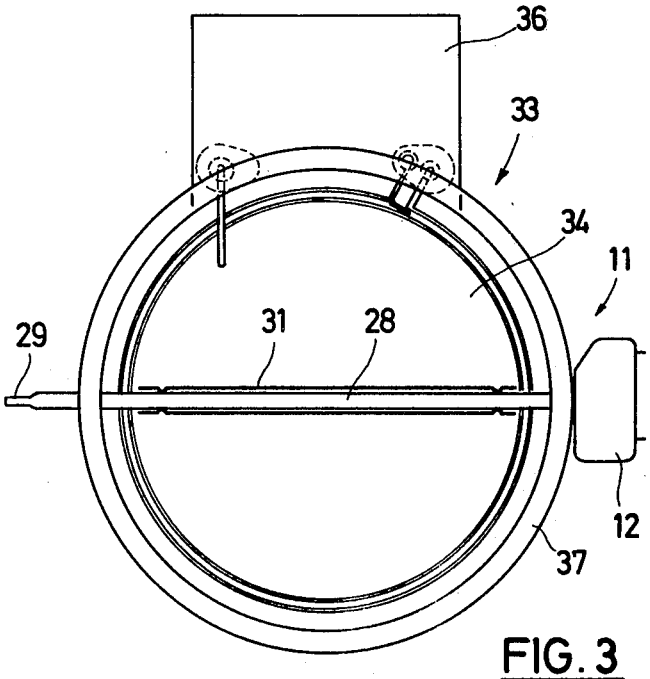
FIG. 3 shows a plan view of the gas heating unit.

FIG. 3 shows a gas heating unit 33 having an upper burner plate 34 acting as a radiant surface. The plate 34 is made of perforated ceramic material through which the gas issues and burns substantially without flames. The burner plate is made to glow in the process and radiates its heat upwards where it penetrates through the glass ceramic plate 35 illustrated in FIG. 4 and heats cooking containers placed on it. A waste gas pipe 36 is connected to the circular burner plate. Apparatuses for igniting and for monitoring the ignition are also provided in this position.

The temperature sensor 28 is arranged between the upper radiant surface of the burner plate 34 and the glass ceramic plate 35, and projects horizontally and exactly diametrally over the gas heating unit in the embodiment illustrated. The sensor is mounted in a retaining ring 37 in such a way that the housing 12 whose recesses 13 and 25 are sealed by an insulating plate, is arranged outside the ring. The end 29 of the temperature sensor 28 also projects outwards through the retaining ring. The portion of the temperature sensor 28 located above the burner plate 34 is surrounded by the enveloping tube 31 which thus has a smaller length than the temperature sensor. It protects the temperature sensor arranged about half way between the burner plate and the glass ceramic plate from the immediate effect of the heating gases and the radiation of the burner plate 34.

Numerous modifications of the embodiments illustrated and described are possible. Thus, for example, a different type of regulator can be used provided it has an elongate rod-shaped or tubular temperature sensor. The temperature sensor can also be made of different materials although the combination of stainless steel and ceramic (steatite) is particularly suitable as sensor material. The fact that the ceramic rod is protected in the stainless steel tube also makes this embodiment favorable. It would also be possible, however, to arrange the material having the highest coefficient of expansion inwards, although this is not necessary owing to the advantages of the invention. The arrangement of the temperature sensor can differ from the diametral arrangement, although the diametral arrangement illustrated covers the most representative area.

The metallic portion 37' of the rod preferably lies at the free end of the temperature sensor, i.e. at the adjusting screw. Owing to the two-part design of the rod it is possible to select the ratios of expansion independently of the length of the sensor needed for spatial reasons and with the materials which are most suitable at any time.

I claim:

1. A gas-heated glass ceramic cooking apparatus comprising:

a glass ceramic cooking surface;

a gas-heating unit having a burner plate with a generally circular radiant heating surface; and, a thermal cut-out comprising: a switch housing; a snap switch arranged in the housing; a temperature sensor extending from the switch housing and cooperating with the snap switch, the temperature sensor comprising a tube with a rod arranged therein, the tube and at least one portion of the length of the rod having differing coefficients of thermal expansion, the tube and the rod being connected to one another at their ends opposite the housing; and, an enveloping tube surrounding the temperature sensor at a distance therefrom, the temperature sensor and the enveloping tube being arranged between the glass ceramic cooking surface and the radiant surface of the burner plate, and extending substantially diametrally with respect to the radiant surface, thereby being subject to the direct thermal and corrosive effects of burning gas, the temperature sensor and the enveloping tube defining an insulating space therebetween, whereby the temperature sensor is insulated from the direct effects of the burning gas, and instead, experiences a clean, even thermal distribution throughout its length.

2. A cooking apparatus according to claim 1, wherein the switch housing and the free end of the temperature sensor project outside the burner plate, and the enveloping tube is arranged only in the region of the radiant surface.

3. A thermal cut-out for gas-heated glass ceramic cooking surfaces, comprising:

a switch housing;

a snap switch arranged in the housing;

a temperature sensor extending from the switch housing and cooperating with the snap switch, the temperature sensor comprising a tube with a rod arranged therein, the tube and at least one portion of the length of the rod having differing coefficients of thermal expansion; and, an enveloping tube which surrounds the temperature sensor at a distance therefrom, the enveloping tube having internal projections for maintaining the distance from the temperature sensor.

4. A thermal cut-out according to claim 3, wherein the internal projections are in the form of moldings.

5. A thermal cut-out according to claim 3, wherein the internal projections are in the form of beads.

6. A thermal cut-out for gas-heated glass ceramic cooking surfaces, comprising:

a switch housing;

a snap switch arranged in the housing;

a temperature sensor extending from the switch housing and cooperating with the snap switch, the temperature sensor comprising a tube with a rod arranged therein, the tube and at least one portion of the length of the rod having differing coefficients of thermal expansion; and, an enveloping tube which surrounds the temperature sensor at a distance therefrom, the space therebetween being filled with an insulating material.

7. A thermal cut-out for gas-heated glass ceramic cooking surfaces, comprising:

a switch housing;

a snap switch arranged in the housing;

a temperature sensor extending from the switch housing and cooperating with the snap switch, the temperature sensor comprising a tube with a rod arranged therein, the tube and at least one portion of the length of the rod having differing coefficients of thermal expansion, the tube and the rod being connected to one another at their ends opposite the housing; and, an enveloping tube surrounding the temperature sensor at a distance therefrom defining an insulating space therebetween, whereby the temperature sensor is insulated from the direct thermal and corrosive effects of burning gas, and instead, experiences a clean, even thermal distribution throughout its length.

8. A thermal cut-out according to claim 7, wherein the enveloping tube is a metal tube.

9. A thermal cut-out according to claim 8, wherein the enveloping tube is of stainless steel.

10. A thermal cut-out according to claim 7, wherein the temperature sensor tube is a metal tube, and the temperature sensor rod consists at least partially of ceramic material.

11. A thermal cut-out according to claim 10, wherein the temperature sensor tube is of stainless steel.

12. A thermal cut-out according to claim 7, wherein the temperature sensor has two portions, one portion of which has a coefficient of expansion which is substantially equal to that of the temperature sensor tube and the other portion of which has a different coefficient of expansion.

13. A thermal cut-out according to claim 12, wherein the other portion of the temperature sensor rod is of ceramic material.

14. A thermal cut-out according to claim 7, wherein the temperature sensor and the enveloping tube define an annular insulating space therebetween.

* * * * *